US007003924B2

(12) United States Patent
Kettler et al.

(10) Patent No.: US 7,003,924 B2
(45) Date of Patent: Feb. 28, 2006

(54) PARQUET BOARD

(75) Inventors: Volker Kettler, Werther (DE); Bernd Schneider, Lage/Billinghausen (DE); Wolfgang Wienstroer, Rheda Wiedenbruck (DE)

(73) Assignee: Witex AG, Augustdorf (DE)

( * ) Notice: Subject to any disclaimer, the term of this patent is extended or adjusted under 35 U.S.C. 154(b) by 671 days.

(21) Appl. No.: 09/821,802

(22) Filed: Mar. 30, 2001

(65) Prior Publication Data

US 2002/0083673 A1 Jul. 4, 2002

(30) Foreign Application Priority Data

Jan. 11, 2001 (DE) ..... 101 01 202

(51) Int. Cl.
*E04L 2/30* (2006.01)
*E04L 2/38* (2006.01)

(52) U.S. Cl. ..... 52/578; 52/592.1; 52/588.1; 52/591.1

(58) Field of Classification Search ..... 52/574, 52/578, 579, 580, 581, 588.1, 589.1, 590.1, 52/604, 403.1, 592.1, 591.1
See application file for complete search history.

(56) References Cited

U.S. PATENT DOCUMENTS

| | | | | |
|---|---|---|---|---|
| 2,740,167 A | | 4/1956 | Rowley | |
| 3,777,430 A | * | 12/1973 | Tischuk | 52/309 |
| 4,065,902 A | * | 1/1978 | Lindal | 52/622 |
| 4,287,693 A | | 9/1981 | Collette | |
| 5,274,979 A | * | 1/1994 | Tsai | 52/595 |
| 5,797,237 A | | 8/1998 | Finkell, Jr. | |
| D406,360 S | | 3/1999 | Finkell, Jr. | |
| 5,950,378 A | | 9/1999 | Council et al. | |
| 6,324,809 B1 | | 12/2001 | Nelson | |
| 6,332,733 B1 | | 12/2001 | Hamberger et al. | |
| 6,505,452 B1 | | 1/2003 | Hannig et al. | |
| 2001/0009085 A1 | * | 7/2001 | Boyer | 52/236.9 |
| 2001/0034991 A1 | * | 11/2001 | Martensson et al. | 52/578 |
| 2002/0020127 A1 | * | 2/2002 | Thiers et al. | 52/403.1 |
| 2002/0046528 A1 | * | 4/2002 | Pervan | 52/588.1 |
| 2002/0059765 A1 | * | 5/2002 | Nogueira et al. | 52/403.1 |

FOREIGN PATENT DOCUMENTS

| | | |
|---|---|---|
| DE | 3343601 | 6/1985 |
| DE | 19854475 | 12/2001 |
| WO | 0102669 | 1/2001 |

* cited by examiner

*Primary Examiner*—Phi Dieu Tran A
(74) *Attorney, Agent, or Firm*—Stevens, Davis, Miller & Mosher, L.L.P.

(57) ABSTRACT

A parquet board with a groove and tongue edge profile comprising a projecting tongue (14) on at least one edge of each parquet board (10,12) and a receding groove (16) on at least one opposite edge of the parquet board. The top edge of the tongue (14) is provided with a projecting locking lip (24) running in the longitudinal direction of the tongue, and there is a corresponding locking recess (26) running in the longitudinal direction of the groove in the bottom edge of the groove-boundary-forming top groove cheek (28).

10 Claims, 1 Drawing Sheet

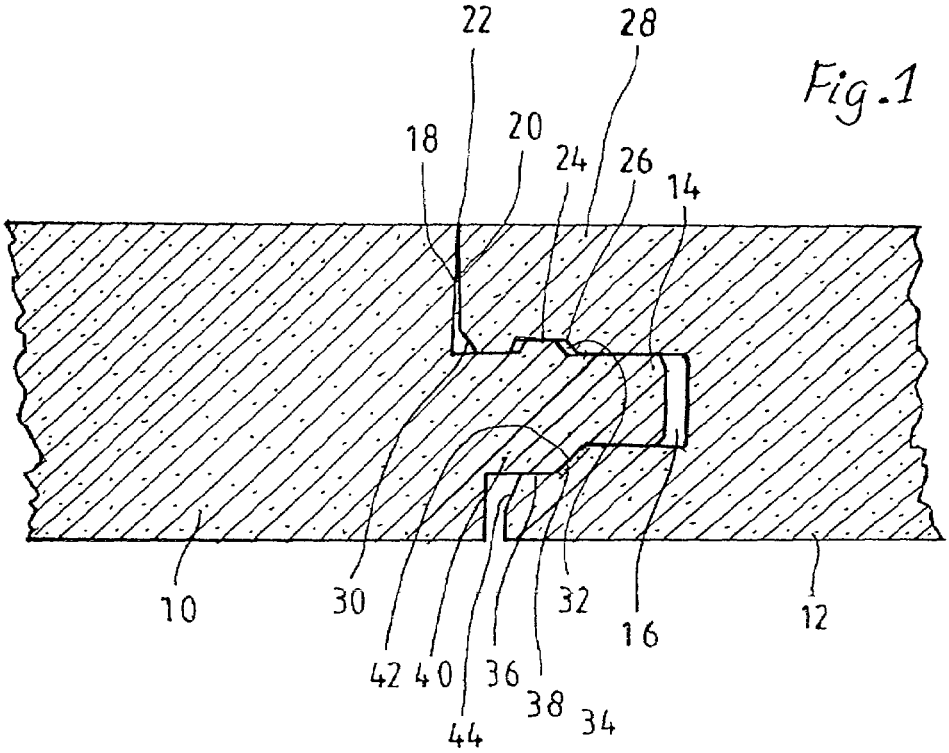
Fig. 1
Fig. 2
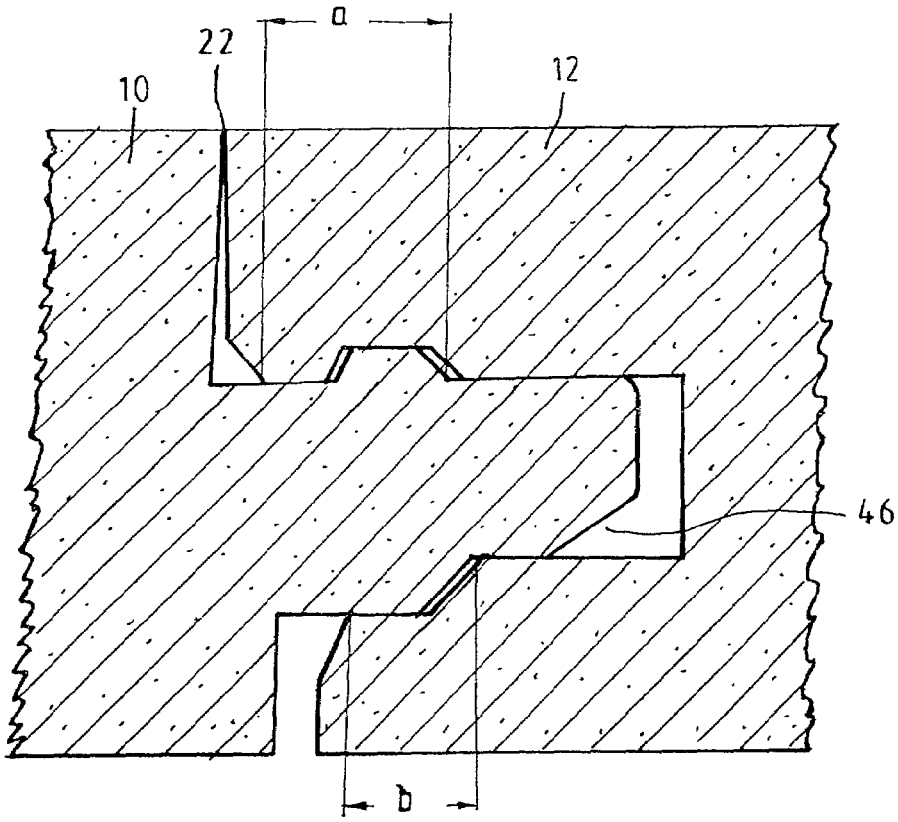

PARQUET BOARD

The invention relates to a parquet board with a groove and tongue edge profile comprising a projecting tongue on at least one edge of each parquet board and a receding groove on at least one opposite edge of the parquet board.

Parquet boards of this type are disclosed in e.g. German utility models 74 00 405 and 74 36 978. These types of parquet boards are joined together with the help of the usual groove and tongue connections plus adhesive. The use of an adhesive makes the process of laying the parquet considerably more difficult. Applying the adhesive to the groove and/or tongue is time-consuming, and there is a constant risk that the adhesive will escape at the surface, or accidentally get onto the parquet surface as it is being applied, so that it then has to be removed in a separate step.

It is for these reasons that solutions based on a modified groove and tongue connection have recently been developed for use with an alternative to parquet floors that has become increasingly popular over the last few years—so-called laminate panels. In these solutions the simple groove and tongue connections are supplemented by locking elements which, after the panels have been assembled, create a lock which holds the panels together inseparably once they have been laid, at least in the laid, horizontal position.

These solutions cannot yet, however, be transferred to parquet elements as the laminate panels are considerably thinner than parquet boards and, on the one hand, are sufficiently elastic to permit the necessary deformation allowing the panels to be snapped together. On the other hand, parquet boards are made from a relatively heavy, multi-layered construction which makes complicated edge profile designs virtually impossible.

The task of this invention is therefore to create a parquet board of the above type so that it will allow a glue-free, form-fitting edge lock with a relatively simple modified groove and tongue connection.

According to the invention, this task is solved in that the top edge of the tongue is provided with a projecting locking lip running in the longitudinal direction of the tongue, and in that a corresponding locking recess running in the longitudinal direction of the groove is contrived in the bottom edge of the groove-boundary-forming top groove cheek.

The dimensions of the locking lip and the locking recess are measured so that adjacent parquet boards can be pushed or hit into each other.

The entry edge of the groove-boundary forming top groove cheek is preferably provided with a tapered or rounded surface to facilitate the passage of the locking lip into the groove. Although this operation also requires a certain elastic deformation of the edge profiles of adjacent parquet boards, said material deformation is largely sufficient to lock adjacent boards together, especially where an appropriate construction is used in conjunction with appropriate force, e.g. hammer blows, as may be applied to parquet, given that it is much thicker.

To facilitate the joining together of adjacent boards, the bottom groove cheek is provided with a gradation towards its free end which enlarges the groove via a tapered surface. The tongue is contrived to match, having a portion of greater thickness in the root zone which runs into the outer portion of the tongue via a similar tapered surface. At least a small gap is preserved between these two tapered surfaces in the assembled position so that the finished end position is not determined by the joining-up of these two tapered surfaces, but solely by the joining-up of the top front ends of adjacent boards above the groove and tongue, thereby ensuring a jointless finish when the boards are laid.

Preferred embodiments of this invention will be described in more detail below with reference to the enclosed drawings, in which:

FIG. 1 is a vertical section through the edge portions of two adjacent parquet boards.

FIG. 2 is an enlarged partial representation of FIG. 1.

The edges of two adjacent boards 10,12, are shown in FIG. 1 enlarged approximately three times. The board on the left has a projecting tongue 14, which engages in a groove 16 in the board 12 on the right.

As shown in the drawing, the boards are assembled with a gap between the front end of tongue 14 and the back end of groove 16, as will be explained below.

The front ends of both boards in the zone above the groove and tongue are designated as 18 and 20. The front end 18 of the left board projects upwards at an angle towards the right board 12, which guarantees that both boards join up in position 22 at the top surface of both boards, thereby ensuring a jointless finish. This is also the reason for the above-mentioned gap between the front end of tongue 14 and the back end of groove 16.

The top edge of tongue 14 is provided with an upwardly projecting locking lip 24 running in the longitudinal direction of the tongue. In the assembled position, this locking lip 24 engages in a corresponding locking recess 26 running in the longitudinal direction of the groove in the bottom edge of top groove cheek 28.

To facilitate the passage of tongue 14 with the projecting locking lip 24 into groove 16, the top groove cheek 28 is provided with a tapered surface 30 at the entry edge of groove 16. This surface may also be rounded instead of tapered. The edge closest to the free end of tongue 14 is provided with a tapered surface 32. The edge of the locking recess is also provided with a tapered surface (not designated) on the corresponding side. It can be seen that in the assembled position, there is at least a small gap between these two tapered surfaces so that here, too, these surfaces do not determine the assembled, pushed together end position, thereby allowing the boards to be laid jointlessly in position 22.

The free end of the bottom groove cheek, which is designated as 34, is provided with a gradation 36 which enlarges the width of groove 16 via a tapered surface 38.

Tongue 14 is correspondingly provided in its root portion, i.e. where it joins with left board 10, with a portion 40 of greater thickness which runs into the non-designated front, or outer, portion of tongue 14 via a tapered surface 42. The two tapered surfaces 38 and 42 are essentially contrived with the same angle of inclination of e.g. 45° in relation to the plane of the board. A slight gap is also preserved between these tapered surfaces when the two boards come into contact with each other in the top assembled position 22.

The drawing also shows that the bottom groove cheek 34 is shorter than top groove cheek 28, so that in the assembled position, the front end of bottom groove cheek 34 remains at a recognizable distance from the corresponding bottom front end of the first board 10.

The front end of bottom groove cheek 34 is also provided with a relatively steep, upwardly inclined tapered surface 44, which is angled upwards at e.g. 60°.

The elasticity of the type of parquet boards in question here is relatively low. This is why gradation 36 is provided inside groove 16.

By way of further explanation, FIG. 2 shows a further enlarged partial representation of the two boards of FIG. 1.

The distance from the entry edge 30 of top groove cheek 28 to the right edge of the locking lip, i.e. the edge closest to the end of the tongue, is designated as a. The distance from the entry edge of the bottom groove cheek to the end of the thicker portion 40 of tongue 14 is designated as b. It can be seen that distance b is considerably shorter than distance a. This means that when locking lip 24 enters groove 16, the thicker portion 40 of tongue 14 is not yet engaged in the graduated portion of the groove, so that the left board can be displaced slightly downwards to facilitate the passage of locking lip 24 into groove 16. This is also the purpose of tapered surface 44 in the top portion of the front end of bottom groove cheek 34.

A similar effect could be achieved by shortening the bottom groove cheek 34. As a consequence of this, however, tongue 14 would not be sufficiently supported inside groove 16. If the boards were laid on a slightly uneven surface, left board 10 might then end up being pushed downwards in relation to the right board, 12 of FIG. 1. This would create a step at position 22, i.e. the joint between the two boards, which would naturally be undesirable. The solution according to the invention, which comprises the gradation in the bottom groove cheek 34 and the thicker portion 40 of tongue 14, both facilitates assembly as shown and guarantees that tongue 14 is fully supported in groove 16 in relation to vertical stresses on the board contrived with the tongue.

Throughout the above description it has been assumed that the locking lip is provided on the top edge of the tongue, and that the gradation in the groove cheek is contrived in the bottom groove cheek. This orientation certainly represents one preferred embodiment based on the assumption that the top groove cheek is generally thicker than the bottom groove cheek and is made from solid wood, so that the fact that the locking recess is contrived in it does not engender any significant weakening. Basically, however, it is possible and reasonable to reverse the embodiment in every respect.

The top portion of parquet boards of the above type is generally made from solid wood, i.e. in the form of solid wood blocks, whilst the bottom portion consists of a substrate of glued softwood or plywood. Medium-thickness fiberboard substrates are regarded as less suitable. The softwood or plywood substrates used in practice have a natural inherent elasticity. This is important for e.g. the bottom groove cheek 34 in this invention, whose elasticity also facilitates the assembly process.

Parquet boards of the type described here are generally manufactured in the shape of relatively long, slim rectangles. The edge profiling described above is conceived for the opposite longitudinal sides in particular.

Profiling of this type can also be used at the front ends, although it will not need to be of the same height as the holding power required here is less.

We return finally to FIG. 2, which shows another feature that can be useful in certain cases. In FIG. 2, in addition to the tongue s tapered surface 42, the outer end of tongue 14 is also provided with a tapered surface 46 on the bottom edge of the outer half portion. This tapered surface 46 serves both to facilitate the assembly of adjacent boards and also to facilitate any subsequent separation of two boards.

As can be seen by FIG. 2, when the locking lip enters the groove during assembly of the parquet board 10 with an adjacent parquet board 12, the thicker portion of the tongue 14 is not yet engaged in the graduated portion 36 of the groove 16 so that the parquet board 10 having the tongue 14 can be displaced slightly downwards to facilitate the passage of the locking lip 24 into the groove 16 in the other board 12.

What is claimed is:

1. A parquet board with a groove and tongue edge profile comprising an upper decorative surface atop a core, a projecting tongue on at least one edge of the parquet board and a receding groove on at least one other edge of the parquet board, wherein the top edge of the tongue is provided with a projecting locking lip running in the longitudinal direction of the tongue, and a corresponding locking recess is provided running in the longitudinal direction of the groove, the edge of the parquet board defining the groove comprising a top groove cheek and a bottom groove cheek, and said recess is formed in a lower portion of the top groove cheek, said top and said bottom groove cheeks defining an entry for the groove, the bottom groove cheek being shorter than the top groove cheek, a gradation is provided on the bottom groove cheek which widens only a portion of the groove and a tapered surface is provided between said widened portion of the groove and the remainder of the groove, the tongue is provided in its root portion with a section of greater thickness than the remainder of the tongue forming a thicker tongue portion, the thickness in the remaining portion of the tongue being connected to said thicker tongue portion via a linear tapered surface, whereby when the locking lip enters a groove of an adjacent parquet board, the groove of the adjacent parquet board having the same shape as the groove of the parquet board, during assembly of the parquet board with the adjacent parquet board, the thicker portion of the tongue is not yet engaged in the graduated portion of the groove so that the parquet board having the tongue can be displaced slightly downwards to facilitate the passage of the locking lip into the groove and the upper surface of one parquet board can be laid jointlessly with an upper surface of an adjacent parquet board.

2. The parquet board of claim 1, wherein an entry edge of the top groove cheek is provided with a tapered surface.

3. The parquet board of claim 1, wherein the locking lip has an edge closest to a free end of the tongue and said edge is provided with a tapered or rounded surface.

4. The parquet board of claim 1, wherein the top cheek of the parquet board projects beyond the groove so that when assembled with an adjacent parquet board, the boards come into contact with each other so as to form a useful top surface.

5. The parquet board of claim 1, wherein the tongue is sized such that, when in an assembled position with an adjacent board the tongue does not have a length which completely fills the groove, such that there is a gap between said tongue and an end of the groove.

6. The parquet board of claim 1, wherein when the board is in an assembled position with an adjacent parquet board, there is at least a small gap between an edge of the locking lip and the corresponding edge of the locking recess.

7. The parquet board of claim 1, wherein when the board is in an assembled position with at least one adjacent parquet board, there is at least a small gap between the tapered surfaces on the groove and on the tongue.

8. The parquet board of claim 1, wherein the parquet board is shaped as a slim, elongated rectangle, and in that the groove and tongue profile is provided on the opposite longitudinal sides.

9. The parquet board of claim 1, wherein there is a tapered surface at an outer end of the tongue, on a bottom side of the tongue.

10. The parquet board of claim 1, wherein the board further comprises a top end above the projecting tongue, wherein said top end is shaped such that, when assembled with an adjacent parquet board having a groove, said top end contacts the top cheek of said adjacent board so as to form a useful top surface.

* * * * *